United States Patent [19]

Smani

[11] 4,008,151

[45] Feb. 15, 1977

[54] PROCESS FOR ENRICHMENT, BY FLOTATION, OF PHOSPHATE ORES WITH GANGUES CONTAINING CARBONATES

[75] Inventor: Smaël Mohammed Smani, Rabat, Morocco

[73] Assignee: Office Cherifien des Phosphates, Rabat, Morocco

[22] Filed: Oct. 29, 1974

[21] Appl. No.: 519,012

[30] Foreign Application Priority Data

Oct. 29, 1973 France ..... 73.38413

[52] U.S. Cl. ..... 209/9; 209/167

[51] Int. Cl.[2] ..... B03B 1/04

[58] Field of Search ..... 209/166, 167, 9

[56] References Cited

UNITED STATES PATENTS

| | | | |
|---|---|---|---|
| 1,914,695 | 6/1933 | Lange | 209/166 |
| 2,105,807 | 11/1938 | Crago | 209/166 X |
| 2,299,893 | 10/1942 | Greene | 209/166 |
| 2,362,432 | 11/1944 | Cahn | 209/166 |
| 2,383,467 | 8/1945 | Clemmer | 209/166 |
| 2,951,585 | 9/1960 | Burks | 209/167 |
| 3,462,107 | 8/1969 | Bushell | 209/166 |
| 3,482,688 | 12/1969 | Bushell | 209/166 |

FOREIGN PATENTS OR APPLICATIONS

| | | | |
|---|---|---|---|
| 528,295 | 7/1956 | Canada | 209/166 |
| 190,829 | 1/1967 | U.S.S.R. | 209/167 |
| 201,266 | 10/1967 | U.S.S.R. | 209/167 |

OTHER PUBLICATIONS

Chem. Abst., 60366h, vol. 69, 1968.

*Primary Examiner*—Robert Halper
*Attorney, Agent, or Firm*—Browdy and Neimark

[57] ABSTRACT

A process for dressing phosphate ores with gangues containing carbonates, by flotation, wherein the phosphates and carbonates contained in the ore to be treated are separated by subjecting the ore to a reverse flotation treatment utilizing a combination of reagents comprising a carbonate flotation collector and agents which modify the surface physical and chemical properties of the phosphate particles and depress the latter. The process also has application to the enrichment of sedimentary and crystalline phosphate ores with gangues containing carbonates and, possibly, silicates and silico-aluminates.

8 Claims, No Drawings

PROCESS FOR ENRICHMENT, BY FLOTATION, OF PHOSPHATE ORES WITH GANGUES CONTAINING CARBONATES

FIELD OF THE INVENTION

The present invention relates to a new process for enrichment, by flotation, of phosphate ores with gangues containing carbonates.

BACKGROUND OF THE INVENTION

It has been known for some time that phosphate ores with siliceous gangues can be enriched by flotation. In accordance with the prior art, the usual processes for enrichment by flotation consist of subjecting the phosphate ores with siliceous gangues to a first flotation utilizing fatty acids; in the froth there is obtained the phosphate and part of the silica of the gangue. This froth is washed with sulfuric acid to eliminate the traces of fatty acids remaining on the phosphate particles and on the silica and silicate grains. The washed product is subjected to a second flotation performed utilizing amines: the silica and silicates are recuperated in the froth while a phosphate concentrate is obtained in the tailings.

However, these known processes are not applicable to separation of the phosphates and carbonates present in phosphate ores with carbonate gangues, firstly because of the similar electrochemical behavior of phosphate and carbonate particles and secondly because of the similar reaction of carbonates and phosphates to the presently-known collectors. In other words, if known processes of enrichment by flotation of phosphate ores with siliceous gangues are applied to flotation of phosphate ores with carbonate gangues, the phosphates are not separated from the carbonates since they float together.

It emerges from the above that, thus far, no success has been had in satisfactorily separating phosphate ores from the carbonate gangue by flotation; research performed thus far has not enabled a flotation enrichment process to be developed for these types of ores. Separation processes for phosphate ores with carbonate gangues used today consist of calcination, generally followed by elimination of the lime produced and sometimes by manufacture of elementary phosphorus. These techniques however require complex and costly installations and therefore have a high cost price.

Furthermore, enrichment processes for phosphate ores with carbonate gangues using calcination apply only to certain types of phosphate ores, namely phosphate ores whose gangues contain predominantly carbonates of alkaline earth metals, excluding ores containing, together with such carbonates, relatively substantial proportions of silica and silico-aluminates which, during calcination, form combinations with the carbonate which cannot be eliminated from the phosphate and which make the product obtained difficult to market due to the impurities it contains.

Flotation processes have a number of advantages, in particular their simplicity of operation, the opportunity they provide of processing considerable tonnages, and, above all, their very low cost price; this is the reason for which it proved desirable to develop a technique able to permit application of flotation processes to enrichment of phosphate ores with carbonate gangues.

SUMMARY OF THE INVENTION

The present invention therefore has the object of providing a new process for enrichment by flotation of phosphate ores with gangues containing carbonates, which responds better to practical requirements than prior processes aimed at processing phosphate ores with carbonate gangues, particularly in that this novel process permits exploitation of the enormous resources represented by phosphate ores with carbonate gangues.

A further object of the invention is to provide a process which permits separation of phosphate ores with carbonate gangues as well as phosphate ores with gangues containing, besides carbonates, silicates and silico-aluminates, which hitherto were fully unexploitable by previously-known calcination processes, as was the case in particular for certain sedimentary phosphates. A still further object of the invention is to provide a process for the separation of phosphate ureas with gangues containing carbonates which is a high-yield process and considerably more economical than the calcination processes of the prior art.

Another object of the present invention is to provide a process of enrichment by flotation of phosphate ores with gangues containing carbonates, wherein the phosphates and the carbonates contained in the treated ore are separated by subjecting said ore to a reverse flotation treatment utilizing a combination of reagents including a carbonate flotation collector and agents modifying the surface physical and chemical properties of the phosphated particles by depressing the same.

DESCRIPTION OF PREFERRED EMBODIMENTS

According to a preferred embodiment of the process according to the present invention, the agents modifying the surface physical and chemical properties of the phosphate particles are essentially a combination of one or more simple or complex metallic salts and one or more complexing agents.

According to another preferred embodiment of the process of the present invention, the phosphates and carbonates are separated by reverse flotation by, in the first stage, treating the ore — which is advantageously in a pulpy state — with one or more simple or complex metallic salts, after which the pulp leaving the first treatment stage is treated by a complexing agent during a second stage, carbonate flotation being achieved in a third stage by introducing a carbonate flotation collector.

The simple or complex metallic salts used according to the invention, in the first treatment stage, are chosen from the simple or complex salts of aluminum, barium, cobalt, copper, iron, nickel, lead, strontium, zinc, etc.

The complexing agents introduced during the second treatment stage according to the present invention are chosen particularly from the chelating agents, particularly the group including acetic, nitro-acetic, latic, oxalic, succinic, tartaric, etc. acids and the salts thereof.

According to an advantageous provision of the process of the present invention, the carbonate flotation collector used in the third process stage is a surfactant with a hydrocarbon chain of 8 to 20 carbon atoms.

This surfactant is chosen from a group including anionic surfactants of the type of fatty acids and their salts, and cationic surfactants of the amine and polyamine type.

According to the invention, the agents modifying the surface physical and chemical properties of the phosphate particles, which depress the latter, are used in quantities equal to or greater than 50 g per ton of solid matter treated.

The maximum depressant effect on the phosphate particles is obtained according to the invention by using a combination of a metallic salt and a complexing agent in a weight ratio of about 1:1 to 1:6.

According to the invention, the carbonate flotation collector is used in a ratio of 300 to 3000 g per ton of solid matter treated.

To utilize the novel process for enrichment by flotation of phosphate ores with gangues containing carbonates according to the invention, one operates preferably under the following conditions:

The phosphate ore with a gangue containing carbonates, treated according to the present invention, can be either a sedimentary phosphate or a crystalline phosphate. After comminution to a suitable particle size, a function of the ore screen, it is converted into the form of concentrated pulp. The ore in pulp form is first conditioned utilizing a given quantity of one or more metal salts, which may be simple or complex salts of aluminum, barium, cobalt, copper, iron, nickel, lead, strontium, zinc, etc.; the metal cation of the salt used exerts an influence on the charge of the phosphates which changes sign and becomes positive, while the charge of the carbonates remains negative.

However, the influence of the metal cations on the charge is not exerted until it is in sufficient concentration, which concentration is preferably equal to or greater than 25 g per ton of solid matter treated.

A second conditioning is then performed by treating the pulp leaving the first conditioning with one or more complexing agents which are particularly chelating agents chosen from the group including acetic, nitroacetic, lactic, oxalic, succinic, tartaric, etc. acids and the salts of these acids.

These complexing agents adhere to the metal cations which adhered to the phosphated particles during the first conditioning to which the ore was subjected, covering these particles with a strongly electronegative hydrophobic layer which makes the phosphated particles selectively hydrophobic.

Successive adsorption of the metal salt and the complexing agent on the surface of the phosphated particles results in a modification of the physical and chemical characteristics of these particles to the extent that they make it possible to apply the flotation process to phosphate ores with gangues containing carbonates, conditioned according to the invention.

Although the quantities of salts of metal cations and complexing agents used vary according to the type of ore treated, it has been shown that excellent results are obtained with 25–500 g metal salt per ton of solid matter treated.

Moreover, the optimum metal salt-complexing agent ratio for obtaining the maximum depressant effect of the phosphate particles is about 1:2.

The treated pulp is subjected, as described above, to the action of a surface-active collector, which is advantageously a hydrocarbon molecule with 8–20 carbon atoms.

This surface-active collector causes flotation of the carbonate gangue; it may be chosen among the anionic surfactants such as the fatty acids and their salts, for example, or among the cationic surfactants of the amine type. It is advantageous to use the surface-active collector in a ratio of 300 to 3000 g per ton of solid matter treated, it being understood that the quantities indicated above are not critical and vary according to the nature of the ore to be treated, one of the advantages of the process residing in the fact that it enables the quantities of collector to be reduced as compared to prior processes and the economic profitability of the process object of the present invention to be enhanced.

After the third stage, flotation of the carbonates takes place in a classic flotation cell.

In addition to the above, the invention also includes other provisions shown in the description hereinbelow.

The present invention relates in particular to the novel process of enrichment by flotation of phosphate ores with gangues containing carbonates, according to the provisions of the present invention, and the means suitable for implementation thereof.

The invention will be described in a more detailed manner in the following examples of the novel process according to the present invention. It must be understood, however, that these examples are provided merely to illustrate the object of the invention and in no way comprise a limitation. It must be understood, however, that these examples are provided merely to illustrate the object of the invention and in no way comprise a limitation.

EXAMPLE 1

The phosphate ore with carbonate gangue to be treated has a particle size of 50–300 microns and a 27.7% concentration of $P_2O_5$ (60.5% tricalcium phosphate). It is composed of approximately 80% by weight of phosphate particles and 20% by weight calcite ($CaCO_3$).

1. The ore is first conditioned by adding iron sulfate, at the rate of 100 g per dry ton of phosphate ore treated, followed by agitation to a concentrated pulp for one minute.

2. The ore is next conditioned by the addition of tartaric acid in the free state or in the form of one of its salts, sodium or potassium salt for example, at the rate of 200 g/dry ton, to the previously-conditioned pulp, followed by agitation for one minute.

3. During the third conditioning of very short duration, less than one minute, there is added to the pulp from the second conditioning step the carbonate flotation collector which, in the present example, is a fatty acid, oleic acid, possibly in its commercially available form of olein, and flotation is carried out in a classical cell in diluted pulp. The quantity of collector used is 940 g/dry ton treated ore.

In a single operation, i.e. without rewashing, the froth constituting the residue has a tricalcium phosphate concentration of 18% and the phosphate concentrate, has a 76% concentration of tricalcium phosphate. The percentage recovery of the $P_2O_5$ contained in the ore is greater than 90%.

EXAMPLE 2

The phosphate ore with carbonate gangue treated has a particle size of 50 to 300 microns and a 29.5% concentration of $P_2O_5$ (64.46% tricalcium phosphate). It is composed approximately of 80% by weight phosphated particles and 20% by weight calcite ($CaCO_3$).

1. The ore is first conditioned by adding aluminum sulfate at 125 g/dry ton phosphate ore treated, followed by agitation to a concentrated pulp for one minute.

2. During the second conditioning step a complexing agent is added consisting of tartaric acid in the free state or in the form of one of its salts, at 250 g/dry ton of phosphate ore treated, to the pulp conditioned in the first stage, followed by agitation for one minute.

3. During the third conditioning step, of very short duration, less than one minute, the carbonate flotation collector is added, oleic acid for example, at 1 kg/ton solid matter treated. Flotation of the carbonates is effected in a classic cell, in the form of diluted pulp.

The froth which constitutes the residue has a tricalcium concentration of 16% phosphate, and the phosphated concentrate has a 76% tricalcium phosphate content.

The percentage of $P_2O_5$ in the ore recovered is greater than 95%.

It emerges from the above description that, however, the methods of implementation, employment, and application adopted, a novel process of enrichment by flotation of phosphate ores with gangues containing carbonates is obtained which presents important advantages with respect to previously known processes with the same purpose, the most striking of which are stated above.

As may be seen from the above, the invention is in no way limited to its methods of implementation, employment, and application described more explicitly hereinabove; rather it embraces all variations that may come to the mind of the expert in the field without departing from the framework or the scope of the present invention.

What is claimed is:

1. The process for enrichment, by flotation, of sedimentary phosphate ores with gangues containing carbonates, comprising:

first subjecting the ore to a treatment modifying the surface physical-chemical properties of the phosphated particles which the ore to be treated contains, with the aid of agents to modify said physical-chemical properties, which agents consist essentially of at least one metal salt having iron or aluminum cations and at least one complexing agent which exerts a chelating action on the phosphated particles previously conditioned by the metal salt, to form a surface complex on said particles;

then, during a second stage, adding a flotation collector of the carbonates, consisting essentially of an anionic surfactant with a hydrocarbon chain containing 8 to 20 carbon atoms, which achieves flotation of the carbonate, the formation of the surface complex on the phosphated particles preventing fixation of the collecting agent on the said particles; and recovering the depressed product, essentially comprised of the sought-after phosphated concentrate.

2. Process according to claim 1, wherein the complexing agents employed are selected from the group consisting of chelating agents of tartaric acids and its salts.

3. Process according to claim 1, wherein the metal salts and the complexing agents are introduced separately and successively in the medium in which the separation of phosphates and carbonates by inverse flotation is brought about.

4. Process according to claim 1, wherein the agents modifying the surface physical-chemical properties of the phosphate particles are employed in a ratio of a quantity of at least 50 g per ton of solid material treated.

5. Process according to claim 1, wherein the metal salt or salts and the complexing agent or agents are present in the combination of agents modifying the surface physical-chemical properties of the phosphated particles in a weight ratio between 1:1 and 1:6.

6. Process according to claim 1, wherein the carbonate flotation collecting agent is employed in a ratio of 300 to 3000 g per ton of solid material treated.

7. Process according to claim 1, wherein said metal salt is selected from the group consisting of the sulphates of iron and aluminum.

8. A process for the enrichment, by flotation, of phosphate ores with gangues containing carbonates, comprising:

converting the phosphate ore with carbonate containing gangue to a concentrated pulp;

mixing said concentrated pulp with an amount sufficient to change the negative charge of the phosphates to positive without changing the negative charge of the carbonates of at least one metal cation selected from the group consisting of aluminum and iron cations, contacted the so-treated pulp with at least one complexing and chelating agent present in an amount sufficient to cover the phosphate particles with a strongly electronegative layer, said complexing and chelating agent comprising tartaric acid or a salt thereof; and separating the phosphates and carbonates contained in the so-treated concentrated pulp by subjecting said so-treated pulp to a reverse flotation treatment by the action of an anionic surface-active collector in an amount sufficient to accomplish said flotation, whereby flotation of the carbonate is achieved and the phosphate is recovered.

* * * * *